United States Patent [19]

Richart et al.

[11] 4,426,173

[45] Jan. 17, 1984

[54] REMOTE ALIGNMENT METHOD AND APPARATUS

[75] Inventors: Jene A. Richart, Houston, Tex.; Bradley D. Beitler, Ojai, Calif.; David G. Deeken, Weybridge, England

[73] Assignee: Exxon Production Research Co., Houston, Tex.

[21] Appl. No.: 296,712

[22] Filed: Aug. 27, 1981

[51] Int. Cl.[3] ..... E21B 7/12

[52] U.S. Cl. ..... 405/195; 166/338; 405/204

[58] Field of Search ..... 405/195, 204, 168-171; 166/338, 339, 340, 341, 342, 343, 344, 345

[56] References Cited

U.S. PATENT DOCUMENTS 3,050,140 8/1962 Hayes ..... 166/341

3,545,539 12/1970 Manning ..... 166/5

3,732,923 5/1973 Fowler ..... 166/344

*Primary Examiner*—Dennis L. Taylor

*Attorney, Agent, or Firm*—Keith A. Bell

[57] ABSTRACT

An apparatus and method are disclosed for aligning equipment lowered from the ocean surface with a fixed subsea structure without the use of guidelines. The apparatus comprises a guide frame including primary and secondary members, a mating guide base including primary and secondary members, vertical channeling means and rotational engagement means. In the practice of the method, the frame is generally positioned above the base using known means of limited precision. Using remote means, the frame is first lowered to vertically channel the primary members into alignment, then rotated until the secondary members are engaged and finally lowered further to fully land the frame on the base.

15 Claims, 9 Drawing Figures

FIG. 8
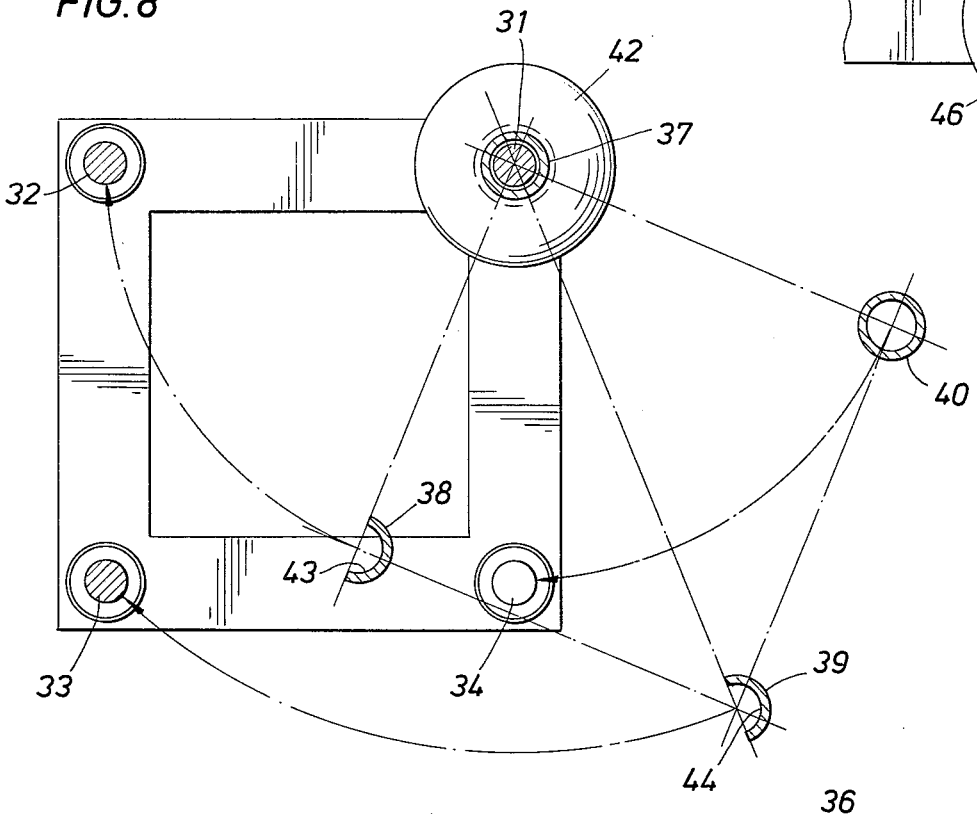
FIG. 9
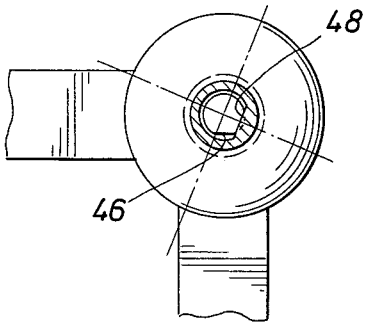
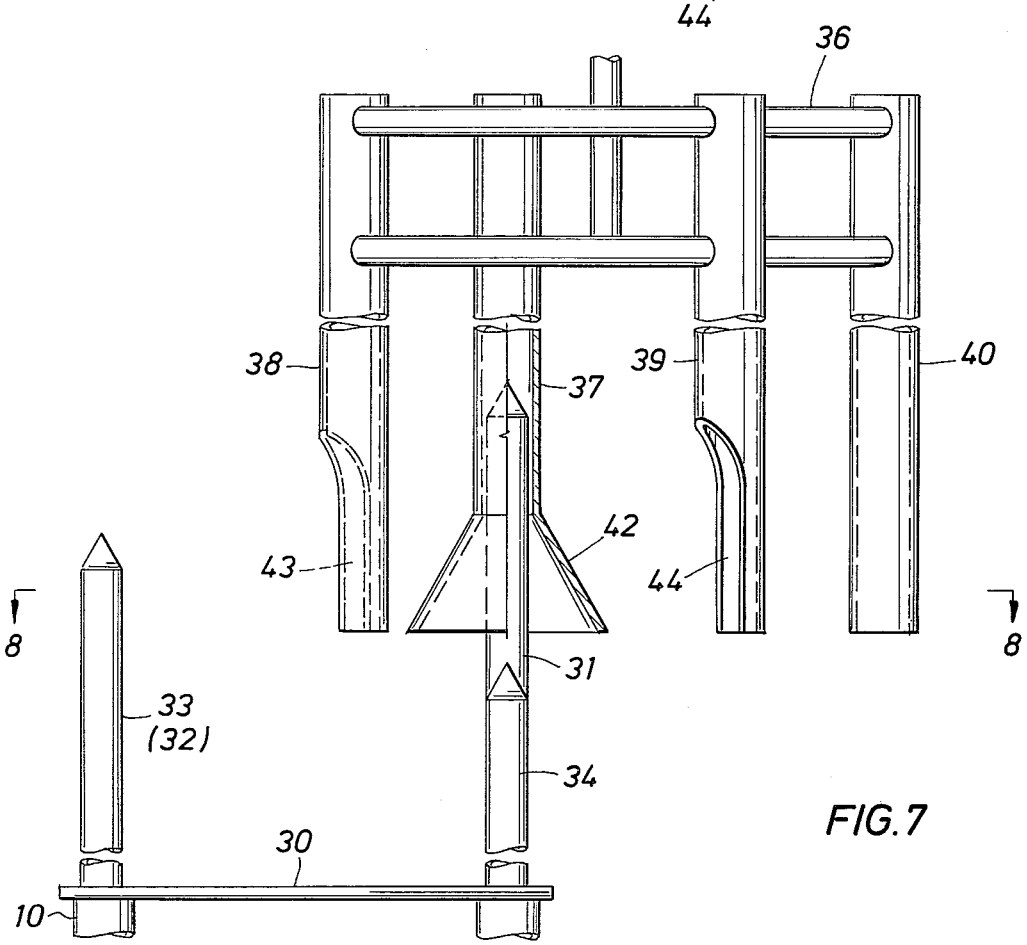
FIG. 7

FIG. 9
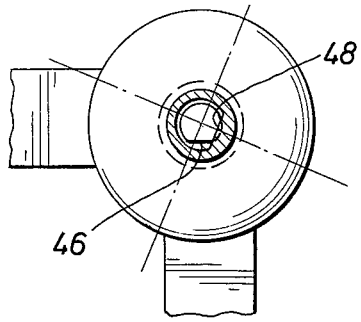
FIG. 8
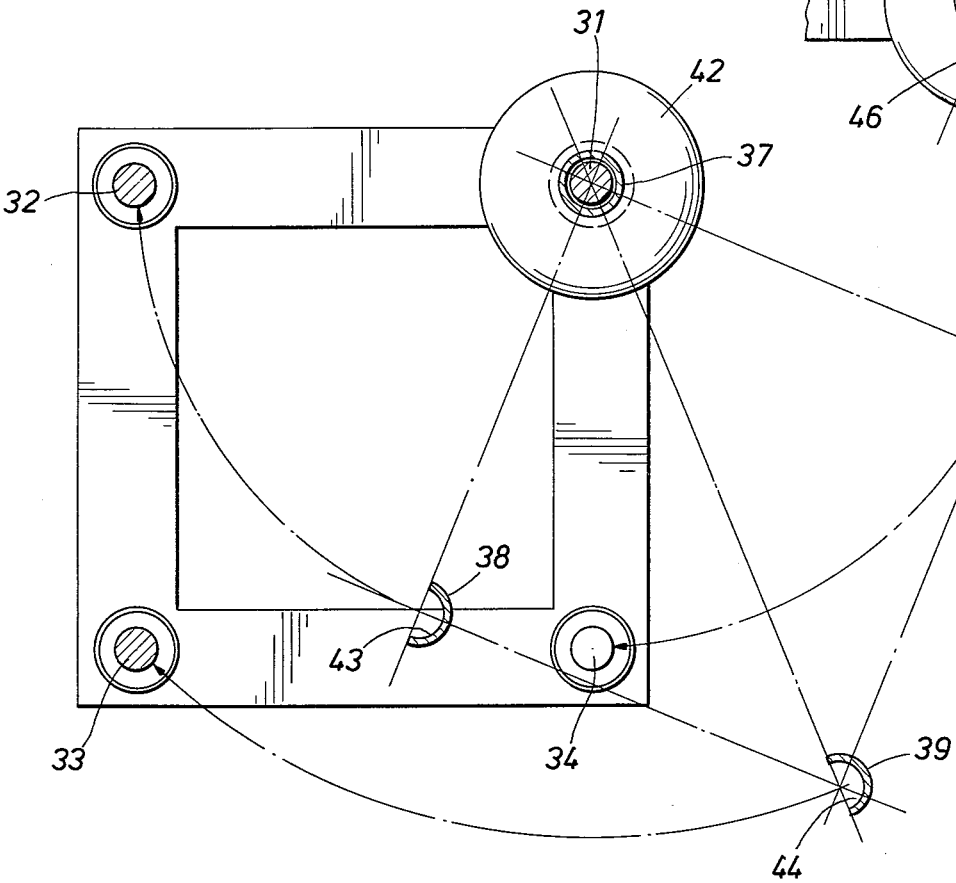
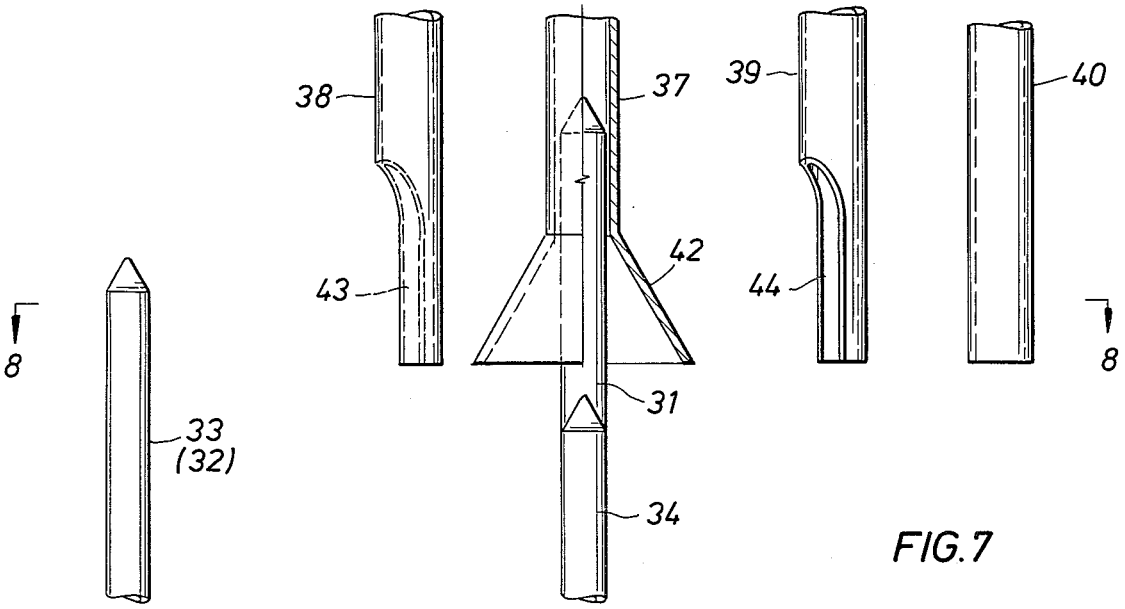
FIG. 7

REMOTE ALIGNMENT METHOD AND APPARATUS

BACKGROUND OF THE INVENTION

This invention relates to an alignment system used to aid the alignment of an object lowered from the ocean surface to a predetermined location on a subsea structure. More particularly, the invention pertains to a method and apparatus for accomplishing the necessary alignment without the use of guidelines.

The development of offshore oil fields frequently involves the construction of fixed subsea facilities for use in conducting drilling, completion and production operations. Fixed subsea facilities are especially useful in oil fields located in deep water where conducting such operations from fixed or floating surface structures would be either prohibitively expensive or technically unfeasible. The installation, operation and maintenance of subsea facilities requires that various types of equipment be lowered from the surface of the body of water to a precise location on the subsea structure. In order to accomplish this, means must be provided for properly aligning the lowered equipment with the target area on the structure.

The most widely employed method of accomplishing this alignment is by the use of guidelines. In a typical guideline system a base is mounted on the subsea structure at the target location. One or more upright guideposts are attached to the base. A tensioned wire rope guideline is connected to the top of each guidepost and extends upwardly to the surface of the body of water. The equipment being lowered is attached to a guide frame which is lowered down the guidelines until it engages the guideposts. In this manner the equipment is directed to the desired position on the subsea structure. See, for example, the guideline system disclosed in U.S. Pat. No. 3,050,139 issued to Hayes (1962). Problems which can occur with guideline systems include breakage and entangling of the lines. Furthermore, when an installation is temporarily abandoned and the guidelines are retrieved, future operations require that the connection between the surface and the subsea facility be reestablished by divers or by other means. Considering that the difficulties associated with guideline systems increase as water depth increases, their use in very deep water is often impractical.

Several alignment methods have been developed which eliminate the need for guidelines. Divers have been used to perform some subsea alignment operations, but their use is not feasible in deep water. Visual observation of the equipment during positioning through subsea TV cameras has also been used to accomplish the necessary alignment. See, for example, U.S. Pat. No. 3,265,130 to Watkins (1966). TV cameras, however, cannot be relied on for all alignment operations as the sea may be too murky to permit viewing of the operation.

Another guidelinesless alignment method is disclosed in U.S. Pat. No. 3,545,539 to Manning (1970). Manning discloses an alignment system comprising a foundation unit having a plurality of stabbing sleeves attached thereto and a satellite body having a plurality of vertical stabbing columns depending therefrom. One of the stabbing columns is longer then the others. This longer stabbing column is partially inserted into its corresponding stabbing sleeve on the foundation unit to provide an axis around which the satellite body may be rotated until the other stabbing columns are vertically aligned with their respective stabbing sleeves. The satellite body is then lowered into its final position. The alignment system disclosed by Manning is not capable of precise rotational alignment without the aid of a manned submersible vessel. When the longer stabbing column has been partially inserted into its stabbing sleeve, there is no way of knowing, absent visual observation, whether the other stabbing columns and stabbing sleeves are properly aligned. Thus, a manned submersible vessel or other means of visual observation is required to properly position the satellite body. The propulsion system attached to the satellite body will cause over-rotation or under-rotation unless directly controlled by visual observation.

In another guidelineless alignment method, a remote guidance system uses sonar or acoustic signals and TV cameras to locate the lowered equipment with respect to the sea floor target. Once the location of the equipment is determined, the equipment is moved laterally and rotated by a propulsion system to attain its proper position above the target. The propulsion system may be combined with the guidance system to automatically make position corrections. See, for example, the remote guidance system disclosed in U.S. Pat. No. 4,167,215 to Thorne (1979). Such systems, however, are often inadequate due to their limited precision. Consequently, once a coarse adjustment has been effected using the remote guidance system, an auxilliary method is required for precise final alignment.

Thus, it can be seen from the above that a need exists for a remote, guidelineless alignment method which is capable of precise alignment.

SUMMARY OF THE INVENTION

The present invention provides a method and apparatus for precisely aligning equipment lowered from the ocean surface with a fixed subsea structure. The alignment apparatus comprises two mating sections, a guide base section and a guide frame section. The guide base section is attached to the subsea structure and includes an upwardly extending primary member and one or more upwardly extending secondary members. The guide frame section includes a downwardly extending primary member and one or more downwardly extending secondary members, matable with the guide base primary and secondary members, respectively. The primary and secondary members of the guide frame and guide base have lengths such that, when the guide frame is suspended above the guide base and lowered toward the guide base, the two primary members engage each other before the secondary members come into contact. Typically this is accomplished by making one of the primary members longer than the secondary members. Also provided on the apparatus are vertical channeling means for aligning the primary members and rotational engagement means for aligning the secondary members. The guide frame may be constructed as an integral part of the equipment lowered and the guide base may be constructed integrally with the subsea structure.

In practicing the method of the invention, the guide frame is lowered from an operational base at the surface of the body of water and positioned generally above the guide base using known methods. It is then lowered to channel into alignment and partially mate the two primary members. The guide frame is then rotated about the guide base primary member until resistance is encountered by engagement of the guide base and guide frame secondary members. To complete the mating of the two pairs of members, the guide frame is then lowered until it is landed on the guide base. where the equipment lowered and the underwater structure do not constitute integral parts of the guide frame and the guide base, the guide frame is attached to the equipment and the guide base mounted on the subsea structure before submergence.

In a preferred embodiment of the apparatus, one member of each mating pair is a post and the other member is a tube adapted to enclose the post. The vertical channeling means is a funnel on the end of the primary tube into which the primary post is guided upon lowering of the guide frame. The rotational engagement means is a partial cylinder on the end of the secondary tube which contacts and fits around the secondary post upon rotation of the guide frame.

The apparatus may include additional members. In a specified embodiment, the guide frame and guide base section each include four members arranged in a square pattern. The guide frame includes a primary member, two secondary members and a tertiary member, all of equal height. The guide base includes a tall primary member, two secondary members of intermediate height and a short tertiary member. Vertical channeling means are provided to align the primary members and rotational engagement means are provided for aligning both pairs of secondary members.

The invention is particularly useful in the offshore oil industry which frequently involves the installation and maintenance of subsea facilities. In a specific application, the apparatus is used to align a maintenance tool lowered from a vessel with a subsea oil production facility. According to the invention, alignment is accomplished by remote operation without the use of divers, guidelines or TV cameras. Thus, the invention may be used in very deep waters. Because precise alignment is achieved with the invention, it is especially appropriate as a final alignment method employed in conjunction with a known method having limited precision such as sonar positioning.

BRIEF DESCRIPTION OF THE DRAWINGS

In order to more fully understand the drawings used in the detailed description of the present invention, a brief description of each drawing is provided.

FIG. 2 is a representation of the alignment apparatus in a first position with the guide frame located generally above the guide base.

FIG. 3 shows the apparatus in a second position with the primary pair of members channeled into alignment.

FIG. 4 shows the apparatus in a third position with the two pairs of secondary members engaged.

FIG. 5 shows the apparatus in a fourth position with all four pairs of members partially mated.

FIG. 6 shows the apparatus in a final position in which the guide frame is fully mated with the guide base.

FIG. 7 is a partial elevation of the apparatus showing in more detail the vertical channeling means and rotational engagement means.

FIG. 8 is a plan view, in partial section, taken along line 8—8 of FIG. 7 showing the operation of the apparatus.

FIG. 9 is a partial plan view illustrating an alternate embodiment of the invention which includes stop means on the two primary members for preventing the guide frame from being lowered too far prior to being rotated into its final position.

DETAILED DESCRIPTION OF THE PREFERRED EMBODIMENT

Figure 1:
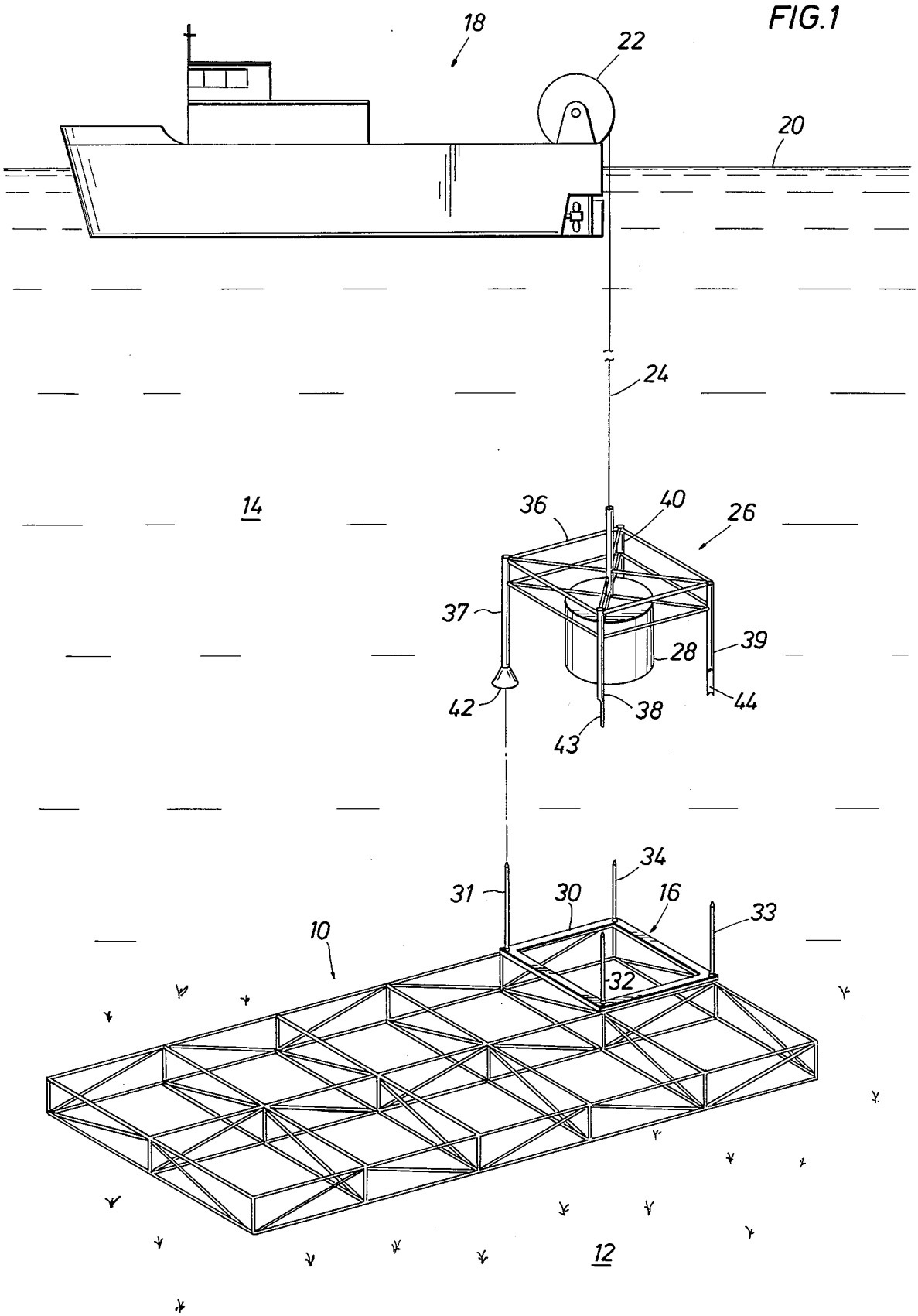
FIG. 1 illustrates the alignment apparatus being used to align a maintenance tool lowered from a vessel with a subsea oil production facility.

FIG. 1 depicts the utilization of the apparatus of the invention to align equipment lowered from the surface of the body of water with a subsea installation. A subsea production facility 10 located on the body 12 of body of water 14 is used to produce oil or gas. A first section of the apparatus, guide base 16, is mounted on subsea production facility 10. A vessel 18 at the surface 20 of body of water 14 is equipped with a winch 22 for lowering and raising cable 24. Suspended from cable 24 is a second section of the apparatus, guide frame 26 carrying a maintenance tool or other device 28.

Figure 2:
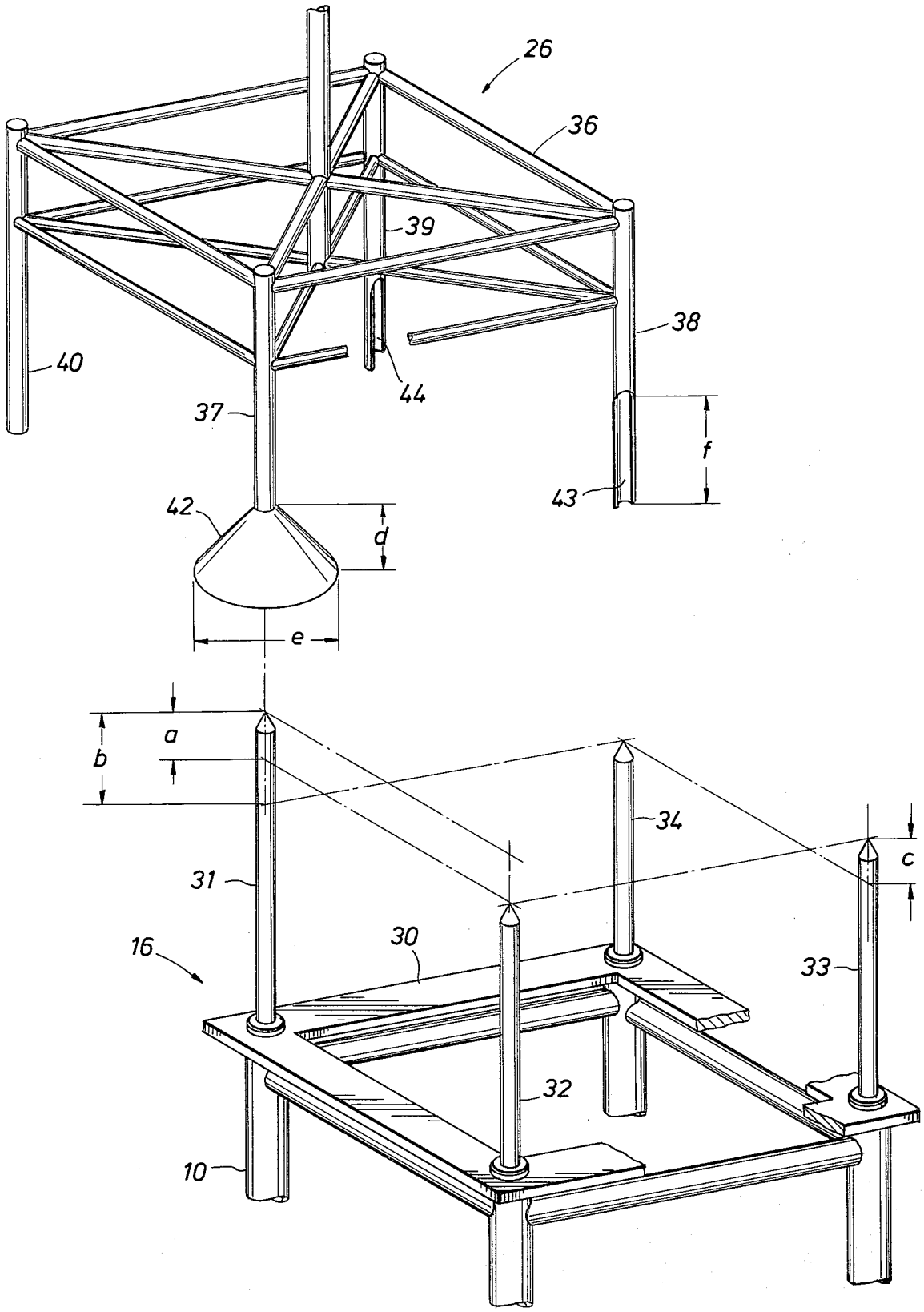
FIGS. 2 through 6 illustrate the position of the alignment apparatus during the sequential steps of the alignment method.

The apparatus is shown in more detail in FIG. 2. The guide base 16 is adapted for mounting on the subsea production facility 10. Guide base 16 includes a generally square base plate 30 and four upwardly extending posts 31, 32, 33 and 34 of approximately equal diameter arranged in a square pattern on base plate 30. The height of the primary post 31 exceeds the height of intermediate posts 32 and 33 by the length a. Intermediate posts 32 and 33 are of approximately equal height. The height of primary post 31 exceeds the height of short post 34 by the length b, greater than length a. The height of intermediate posts 32 and 33 exceed the height of short posts 34 by the length c which equals b minus a. As will be discussed more fully below, the purpose of short post 34 is to allow the apparatus to operate with an initial angular misalignment during prepositioning of almost 270°.

Guide frame 26 is adapted for attachment to maintenance tool 28 (shown in block form in FIG. 1 only) which may be any tool needed to perform the desired operation. Guide frame 26 includes a square body 36 and four tubular members 37, 38, 39 and 40 of approximately equal diameter, each extending below the square body 36 to the same elevation. The four tubular members 37, 38, 39 and 40 are positioned on the square body 36 in the pattern of a square approximately equal in size to the square formed by the posts 31, 32, 33 and 34 on the base plate 30. Each of the tubular members is thus positioned to correspond with one of the posts.

The inside diameters of the four tubular members are slightly greater than the outside diameters of the four posts so that the tubular members can fit closely over the posts when the guide frame 26 is mated with the guide base 16. Specifically, member 37 is adapted to mate with post 31, member 38 is adapted to mate with post 32, member 39 is adapted to mate with post 33 and member 40 is adapted to mate with post 34.

The primary tubular member 37 flares outwardly at its lower end to form a funnel 42 of length d. The purpose of funnel 42 is to channel the primary member 37 into vertical alignment with primary posts 31. Thus, the funnel 42 may be referred to as a vertical channeling means. The diameter e of the large end of funnel 42 is determined by the precision of the means available for the lateral prepositioning of funnel 42 and post 31, discussed below. Where the precision of the prepositioning means in attaining a specific lateral location is plus or minus a given distance, the diameter e should be at least twice that distance to allow an appropriate margin for error in prepositioning. The secondary tubular members 38 and 39 are partially cut away at their lower ends to form vertical half cylinders 43 and 44 of approximately equal length f. The purpose of half cylinders 43 and 44 is to engage members 38 and 39 with posts 32 and 33 upon rotation. Thus, the half cylinders 43 and 44 may be referred to as rotational engagement means. Each cut is made on a vertical plane through the center of the tube thereby forming half cylinders. As best shown in FIG. 8, these vertical planes preferably are oriented along lines leading from the center of primary tubular member 37 to the center of the particular post. Specifically, half cylinder 43 is formed along a line leading from the center of primary tubular member 37 to the center of secondary tubular member 38 and half cylinder 44 is formed along a line leading from the center of primary tubular member 37 to the center of secondary tubular member 39. Thus, the opening of each half cylinder is oriented along a line tangent to its rotation. The above described orientation of the half cylinders is preferable in order for the half cylinders to properly mate with their respective posts on guide base 16. The tertiary tubular member 40 is a full cylinder.

Turning now to a discussion of the alignment method, it is desired to align maintenance tool 28 (see FIG. 1) initially located at the surface 20 of body of water 14 with subsea production facility 10, fixed on the bottom 12, in a desired position for performing maintenance operations. Guide base 16 is first mounted on the subsea production facility 10. This is normally done prior to installation of the subsea facility. In an alternative embodiment, guide base 16 is constructed as an integral part of subsea production facility 10. On vessel 18, guide frame 26 is attached to maintenance tool 28 in a position such that, when guide frame 26 is properly mated with guide base 16, tool 28 is positioned in the desired relationship with respect to subsea production facility 10. If, alternatively, guide base 26 and tool 28 have been constructed as a single unit, attachment is not required.

Next, guide frame 26, along with attached tool 28, is suspended from vessel 18 by cable 24, submerged in the body of water 14 and lowered using winch 22 to a position above guide base 16 in preparation for alignment. The positions of the apparatus during the alignment procedure are shown sequentially in FIGS. 2 through 6. By moving guide frame 26 laterally, funnel 42 is positioned generally over post 31 so that the vertical axis of post 31 is within the circumference of the large end of funnel 42 as shown in FIG. 2. Any of several methods, well known in the applicable art, may be used to aid in properly prepositioning the funnel 42 over the primary post 31. Such methods include, but are not limited to, acoustic or sonar positioning systems and unmanned submersible work vessels. The lateral movement of guide frame 26 is achieved by moving vessel 18 or by using other means known in the art, such as a remotely controlled propulsion system attached to the guide frame. The proper location of funnel 42 is determined using a remote guidance system or other known means. It is only necessary that the prepositioning means be precise enough to attain the position described, considering the diameter e of funnel 42 as described above.

Figure 3:
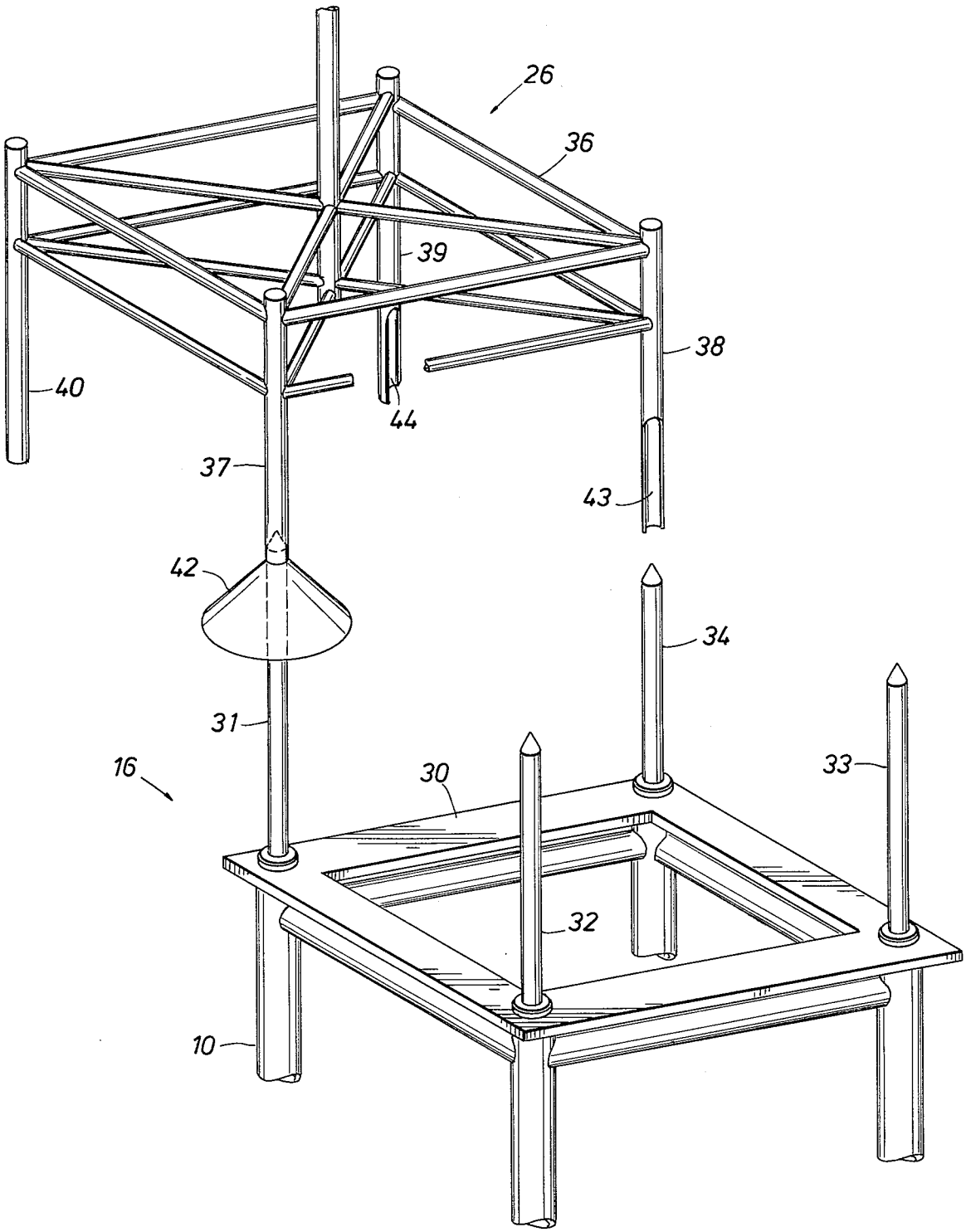

Guide frame 26 is then lowered so that the end of post 31 is channeled toward the center of funnel 42 by the funnel walls. This channeling process moves guide frame 26 laterally to a position in which primary tubular member 37 and post 31 are vertically aligned. The distance which the guide frame should be lowered is determined by the dimensions of the apparatus. Once the large end of funnel 42 has been lowered to a level equal to that of the top of post 31, the frame is further lowered by a distance greater than length a, less than length b, greater than length d and less than the sum of lengths a and f. The distance is greater than length a so that, after lowering, the lower ends of tubular members 38, 39 and 40 extend below the level of the upper ends of intermediate posts 32 and 33. The distance lowered is less than length b to maintain members 38, 39 and 40 above the top of short post 34. The distance lowered is greater than length d so that post 31 is inserted a short distance into the narrow tubular position of member 37 to partially mate post 31 and member 37 as shown in FIGS. 3 and 7. Finally, the distance is less than the sum of lengths a and f so that the full cylindrical portions of members 38 and 39 remain above the upper ends of posts 32 and 33.

Figure 4:
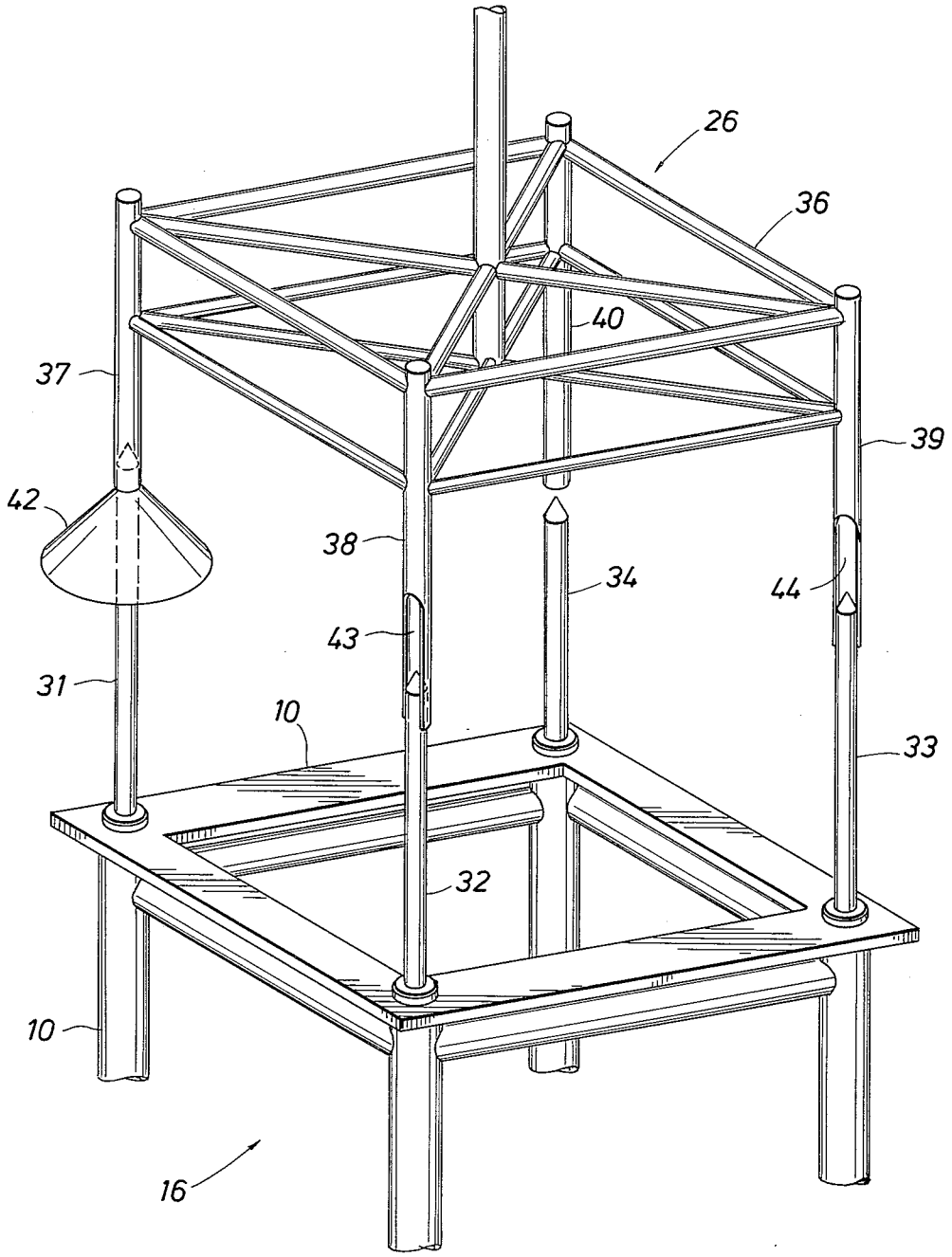

After being lowered, the guide frame is rotated in a clockwise direction about the vertical axes of primary member 37 and primary post 31, as best shown by the arrows in FIG. 8. The rotational force may be provided by a propulsion system mounted on the guide frame or, alternatively, by a pipe string attached to the guide frame at one end and rotated by a rotary table on the surface vessel. Other means of rotating the guide frame will be obvious to those skilled in the art. As the guide frame is rotated, secondary members 38 and 39 approach intermediate posts 32 and 33 respectively. In an alternative embodiment, half cylinders 43 and 44 are formed on the sides of members 38 and 39 opposite those described above (see FIG. 8) and the frame is accordingly rotated in a counterclockwise direction. As shown in FIG. 7, during rotation the lower ends of all four tubular members remain above the top of short post 34. Referring now to FIG. 4, when members 38 and 39 reach posts 32 and 33 respectively, the upper full cylindrical portions of members 38 and 39 remain above the posts. However, half cylinders 43 and 44 contact and engage the upper ends of posts 32 and 33 respectively. Resistance to further rotation of the guide frame is thereby encountered and rotation is stopped. The extent of rotation required need not be known in advance because the encountering of resistance indicates when the proper angle has been achieved. During rotation, none of the tubular members will come into contact with short post 34 because the top of short post 34 is located below the bottoms of tubular members 38, 39 and 40. Thus, the apparatus will tolerate an initial angular misalignment during prepositioning of almost 270°, measured in a counterclockwise direction from the desired position. After rotation, secondary members 38 and 39 are vertically aligned with intermediate posts 32 and 33 respectively. Tertiary member 40 and short post 34 are now also in vertical alignment. Thus, guide frame 26, as a whole, is vertically and rotationally aligned with guide base 16.

Figure 6:
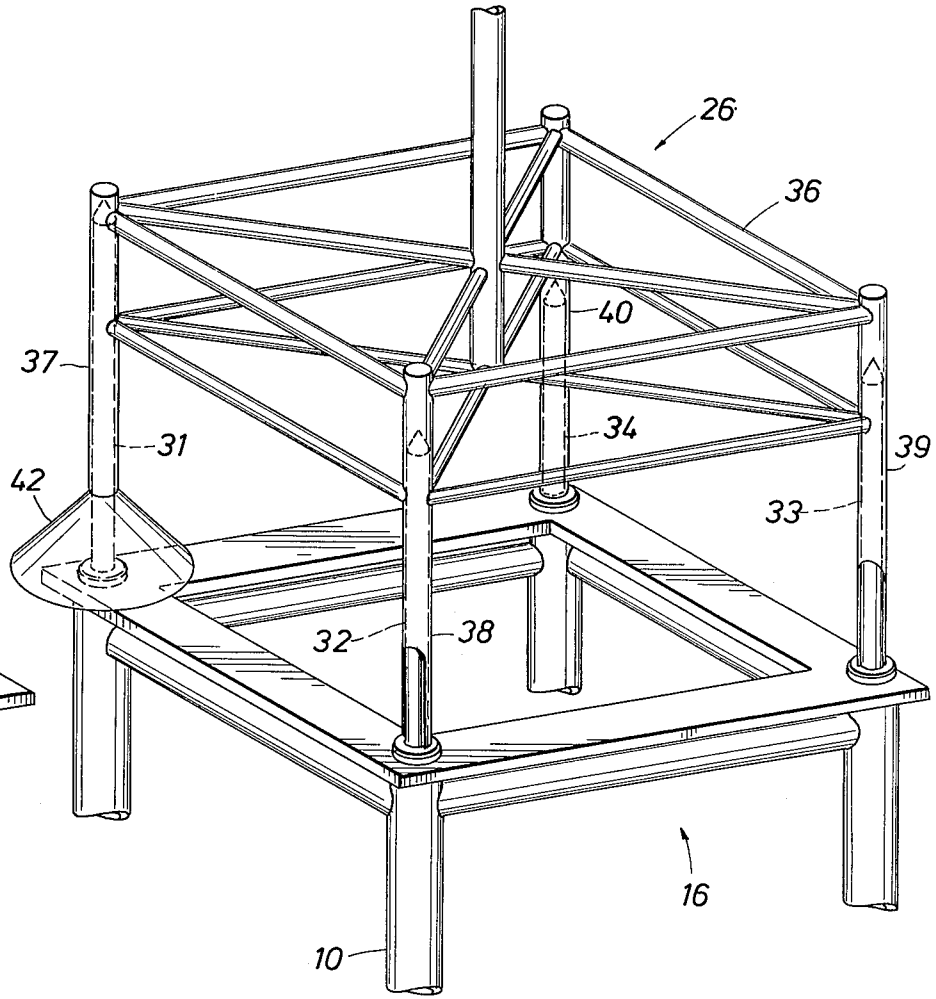
Figure 5:
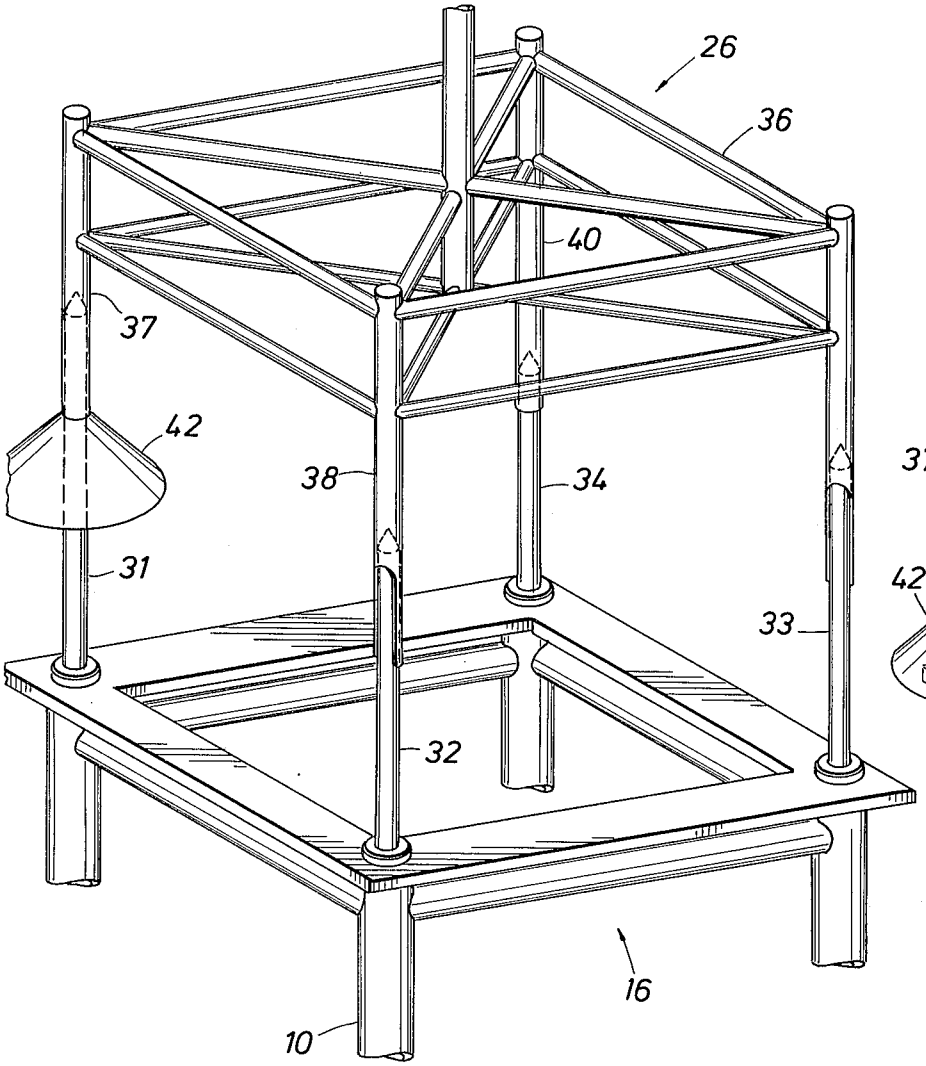

To complete the mating of the guide frame and guide base, guide frame 26 is further lowered to insert posts 32 and 33 into the full cylindrical portions of members 38 and 39 and to insert short post 34 into member 40 (see FIG. 5). Lowering is continued until the four tubular members are fully mated with the four posts and the frame is landed on the base plate 30 as shown in FIG. 6.

Maintenance tool 28 (see FIG. 1) is now located in the desired position with respect to subsea production facility 10 for affecting the desired operations thereon. After the work is completed, the guide frame and tool can be recovered by raising the guide frame to separate it from the guide base. If it is desired to leave the tool at the subsea production facility, the guide frame may first be detached from the tool.

In an alternative embodiment short post 34 is eliminated. Thus, one corner of the square pattern on base plate 30 is unoccupied. The unoccupied corner would be adjacent primary post 31. In this embodiment when the guide frame and the guide base are fully mated, tubular member 40 rests on base plate 30 without a corresponding post. The necessary alignment is accomplished by the primary and secondary posts and members.

A second alternative embodiment is illustrated in FIG. 9. A flat surface 46 is formed on one side of primary post 31 and a corresponding flat surface 48 is formed in the interior of primary tubular member 37. The two flat surfaces are oriented so as to prevent engagement of the two primary members unless the guide frame is properly angularly aligned. As the two primary members channel into partial engagement, as shown in FIG. 3, flat surface 48 will come into contact with the top of primary post 31 thereby preventing further lowering. After guide frame 26 has been rotated into the position shown in FIG. 4 the two flat surfaces will be aligned and the guide frame may be lowered into its final position.

The preceding describes only one specific embodiment of the present invention. Parts of the apparatus, such as the square body 36 and the base plate 30 may take various shapes. The invention includes, at a minimum, two pairs of mating members. A primary member on the guide frame is adapted to mate with a primary member of the guide base. The mating of this primary pair vertically aligns one point of the guide frame with one point on the guide base. A secondary member on the guide frame is adapted to mate with a secondary member on the guide base. This second mating vertically aligns a second point on the guide frame with a second point on the guide base and therefore aligns the guide frame rotationally with respect to the guide base. For each pair of mating members, the male member may be located on the guide frame and the female member on the guide base, or vice versa. Male members must extend free from the body of the guide frame or the guide base on which they are constructed in order to permit the female members to fit over them for the length required in the particular application. The four required members of the apparatus may have various lengths so long as the vertical distance between the two secondary members is greater than the vertical distance between the two primary members when the guide frame is suspended above the guide base. This feature permits the primary members to make contact with each other before the secondary members make contact during the lowering of the guide frame. The apparatus may include additional pairs of members for ease in handling or other purposes which do not interfere with the alignment function of the primary and secondary pairs. The members may be positioned in various configurations on the guide base with the guide frame members arranged in a corresponding configuration in accordance with the principles of the invention.

The means for channeling the two primary members into vertical alignment has been described as a circular funnel on the end of the primary tubular member. Alternate shapes and types of vertical channeling means may be employed on the apparatus such as, for example, a square funnel. The half cylinders described on the secondary tubular members are only one embodiment of a rotational engagement means for engaging the secondary members upon rotation of the guide frame. Partial cylinders which are less than half cylinders may be used. Other appropriate rotational engagement means include open ended forms such as U-shaped or V-shaped structures.

The invention is applicable to the lowering of any object from one location to a structure at a remote lower location where means are available for general positioning of the object and further vertical and rotational alignment is required. In the offshore oil industry, numerous drilling, completion and production operations require such alignment. These operations include the installation of temporary and permanent guide bases, wellheads, Christmas trees and risers. Maintenance operations frequently require the lowering of a tool for removing a defective valve or control module, for inserting a replacement module or for effecting in-place repairs on various subsea devices.

According to the method of the invention, all movements of the guide frame during alignment are controlled remotely from an operational base on a vessel or offshore platform from which the guide frame is suspended. No visual observation, divers or guidelines are required. Thus, the invention can be used where ocean conditions make the use of such means difficult. The apparatus is especially appropriate for use in conjunction with a coarse alignment apparatus such as an acoustic or sonar position referencing system having limited precision. In such an application, the acoustic or sonar system can be used for general positioning of the object and the present invention thereafter used for precise final alignment.

It should be understood that this invention is not to be unduly limited to the foregoing which has been set forth for illustrative purposes. Various modifications and alterations of this invention will become apparent to those skilled in the art without departing from the true scope of the invention defined in the following claims. For example, the four members may be arranged in a pattern other than square so that, during rotation, each rotating member will have a different radius of curvature. Such an arrangement would allow the apparatus to accommodate an initial angular misalignment during prepositioning of almost 360°.

What we claim is:

1. An apparatus for guidelineless alignment of equipment lowered from a vessel located at the surface of a body of water to a subsea structure located on the floor of said body of water, said apparatus comprising:

a base having an upwardly extending primary member and at least one upwardly extending secondary member, said base being located on and attached to said subsea structure;

a frame on which said equipment is mounted, said frame having a downwardly extending primary member capable of mating with said base primary member and at least one downwardly extending secondary member capable of mating with said base secondary member, said members having lengths such that said primary members engage each other before said secondary members come into contact as said frame is lowered toward said base;

means for lowering said frame form said vessel to said subsea structure;

vertical channeling means attached to at least one of said primary members and adapted to aid in channeling said primary members into engagement thereby defining a substantially vertical axis through both said base primary member and said frame primary member; and rotational engagement means for rotationally aligning said base and said frame, said rotational engagement means attached to at least one of said secondary members and adapted to permit a predetermined amount of rotation of said frame about said substantially vertical axis and to prevent further rotation when said frame and said base are angularly aligned.

2. The apparatus of claim 1 wherein one of said primary members is post-shaped and the other of said primary members is tubular and wherein one of said secondary members is post-shaped and the other of said secondary members is tubular.

3. The apparatus of claim 2 wherein said vertical channeling means is a funnel-shaped end portion of said tubular primary member.

4. The apparatus of claim 2 wherein said rotational engagement means is a partial-cylindrical end portion of said tubular secondary member.

5. The apparatus of claim 1 wherein said frame primary member and said frame secondary member extend downwardly from said frame and are of approximately equal lengths and wherein said base primary member is taller than said base secondary member.

6. An apparatus for guidelineless alignment of equipment lowered from a vessel located at the surface of a body of water with a subsea structure located on the floor of said body of water, said apparatus comprising:

(a) a base located on and attached to said subsea structure, said base having (1) an upwardly extending primary post, and (2) two upwardly extending secondary posts of approximately equal height shorter than said primary post.

said primary and secondary posts being positioned on said base at three of the four corners of a generally square pattern so that said primary post is adjacent the unoccupied corner of said square pattern; and (b) a frame on which said equipment is mounted, said frame attached to said vessel and capable of being lowered from said vessel to said subsea structure, said frame having (1) a downwardly extending primary tubular member adapted to mate with said primary post and having a downwardly widening funnel formed at its lower end, said funnel adapted to aid in channeling said primary post into engagement with said primary tubular member thereby defining a substantially vertical axis through both said primary post and said primary tubular member, (2) two downwardly extending secondary tubular members, each of said secondary tubular members adapted to mate with one of said secondary posts and having a half cylinder formed at its lower end, said half cylinders oriented so as to engage said mating secondary posts when said frame is rotated about said substantially vertical axis into angular alignment with said base, and (3) a downwardly extending tertiary tubular member, said primary, secondary and teritiary members extending downwardly from said frame approximately equal distances and being arranged on said frame in a generally square pattern corresponding to said square pattern on said base so that said primary tubular member corresponds to said primary post, said secondary tubular members correspond to said secondary posts and said tertiary tubular member corresponds to said unoccupied corner of said base square pattern.

7. The apparatus of claim 6 wherein said base further comprises an upwardly extending tertiary post shorter than said secondary posts, said tertiary post being positioned on said base at said unoccupied corner of said square pattern so as to correspond to and mate with said tertiary tubular member.

8. An alignment apparatus for use in guidelineless alignment of equipment lowered from a vessel at the surface of a body of water to a subsea structure, said alignment apparatus comprising:

an upwardly extending primary male member and one or more upwardly extending secondary male members attached to said subsea male members attached to said subsea structure, said primary male member being taller than said secondary male members;

a guide frame on which said equipment is mounted, said guide frame having a downwardly extending primary female member adapted to mate with said primary male member and one or more downwardly extending secondary female members adapted to mate with said secondary male members, said primary and secondary female members being of approximately equal length;

means for lowering said frame from said vessel to said subsea structure;

vertical channeling means attached to said primary female member for channeling said primary male member into engagement with said primary female member thereby defining a substantially vertical axis through both said primary male member and said primary female member; and rotational engagement means for rotational aligning said frame with said subsea structure, said rotational engagement means attached to said secondary female members and adapted to permit a predetermined amount of rotation of said frame about said substantially vertical axis and to prevent further rotation when said frame and said subsea structure are angularly aligned.

9. A method for guidelineless alignment of equipment lowered from the surface of a body of water to a subsea structure having a base mounted thereon, said base having an upwardly extending base primary member and one or more upwardly extending base secondary members shorter than said base primary member, said equipment being attached to a guide frame having a downwardly extending frame primary member and one or more downwardly extending frame secondary members adapted to mate with said base primary and secondary members respectively and wherein said frame primary member includes vertical channeling means to channel said base and frame primary members into engagement and said frame secondary members include rotational engagement means adapted to permit a predetermined amount of rotation of said frame with respect to said base and to prevent further rotation when said frame and said base are angularly aligned, said method comprising the steps of:

moving said guide frame to a submerged location in which said frame primary member is positioned generally above said base primary member;

lowering said guide frame so that said base and frame primary members channel into engagement and partially mate thereby defining a substantially vertical axis through said base and frame primary members, rotating said guide frame about said substantially vertical axis until said rotational engagement means positively engages said base secondary members thereby preventing further rotation; and lowering said frame to fully mate said primary members and said secondary members.

10. The method of claim 9 wherein the moving of said frame to said submerged location is accomplished by use of an acoustic or sonar position referencing and propulsion system.

11. The method of claim 9 wherein the rotation of said frame is accomplished by use of a remote controlled propulsion system.

12. The method of claim 9, said method further comprising the steps of:

detaching said equipment from said frame after said frame and said base have been fully mated;

raising said frame to separate said primary members and said secondary members; and returning said frame to the water surface.

13. The apparatus of claim 1 wherein said apparatus further comprises stop means adapted to permit said primary members to channel into partial engagement when said base and said frame are angularly misaligned and further adapted to prevent said primary members from channeling into complete engagement unless said base and said frame are properly angularly aligned.

14. The apparatus of claim 13 wherein said stop means is a first flat surface formed on said base primary member and a second flat surface formed on said frame primary member, said first and second flat surfaces oriented so as to correspond only when said base and said frame are properly angularly aligned.

15. The apparatus of claim 6 wherein said apparatus further comprises a first flat surface formed on the periphery of said primary post and a second flat surface formed on the interior of said primary tubular member, said first and second flat surfaces oriented so as to permit complete engagement of said primary post and said primary tubular member only when said frame and said base are angularly aligned.

* * * * *

UNITED STATES PATENT AND TRADEMARK OFFICE

CERTIFICATE OF CORRECTION

PATENT NO. : 4,426,173

DATED : January 17, 1984

INVENTOR(S) : Jene Arlan Richart, Bradley Dean Beitler, and David Gordon Deeken

It is certified that error appears in the above—identified patent and that said Letters Patent is hereby corrected as shown below:

IN THE DRAWINGS:

1. Delete Sheet 7 of 7.

IN THE CLAIMS:

In Claim 1 at Column 9, Line 4 delete "form" and insert "from" therefor.

In Claim 8 at Column 10, Line 47 delete the second occurrence of "rotational" and insert "rotationally" therefor.

Signed and Sealed this

*Eighth* Day of *April 1986*

[SEAL]

*Attest:*

DONALD J. QUIGG

*Attesting Officer*

*Commissioner of Patents and Trademarks*